US006945804B1

(12) United States Patent
Lin

(10) Patent No.: US 6,945,804 B1
(45) Date of Patent: Sep. 20, 2005

(54) SINGLE SOCKET CONTAINING TWO LAMPS TOWARD OPPOSITE DIRECTIONS

(76) Inventor: Mei-Lu Lin, P.O. Box 697, Fongyuan City, Taichung County (TW) 420

( * ) Notice: Subject to any disclaimer, the term of this patent is extended or adjusted under 35 U.S.C. 154(b) by 151 days.

(21) Appl. No.: 10/922,844

(22) Filed: Aug. 23, 2004

(51) Int. Cl.[7] ..... H01R 4/50; H01R 13/625
(52) U.S. Cl. ..... 439/336; 439/541; 362/252
(58) Field of Search ..... 439/336, 541, 439/335, 182, 226, 280, 375, 661; 362/430, 362/249, 252

(56) References Cited

U.S. PATENT DOCUMENTS

| | | | | |
|---|---|---|---|---|
| 852,489 | A * | 5/1907 | Benjamin | 439/541 |
| 1,241,106 | A * | 9/1917 | Frydrychowicz | 439/541 |
| 1,469,038 | A * | 9/1923 | Erikson | 439/541 |
| 5,435,741 | A * | 7/1995 | Wang | 439/336 |
| 5,938,314 | A * | 8/1999 | Lin | 362/249 |
| 6,634,766 | B1 * | 10/2003 | Gordon | 362/249 |
| 6,779,911 | B2 * | 8/2004 | Chang | 362/430 |

* cited by examiner

*Primary Examiner*—Michael C. Zarroli

(57) ABSTRACT

A single socket containing two lamps toward opposite directions includes a longitudinal lateral opening, an introrse plate and a pair of the first wire grooves in the center for disposing a pair of electric wires, a pair of flat surfaces each having a transverse retaining slot and a retaining edge, a pair of separated slits and a single slit in two sides of the flat surfaces for respectively disposing a pair tipped contact plates and a common contact plate and a pair of first retaining recesses through the peripheral walls adjacent the upper and lower rims, a cover closing the lateral opening having a pair of second wire grooves, two pairs of the hooked plates and a pair of second retaining recesses in inner side respectively engaged with first wire grooves, the transverse retaining slots and the retaining edges of the opening, a pair of lamps inserted into the upper and lower rims of the socket each having a pair of lead-in wires engaged with the contact plates respectively and a pair of retaining rings respectively sleeved on the outer periphery adjacent the upper and lower rims of the socket.

2 Claims, 7 Drawing Sheets

(2-2)

(2'-2')

(2"-2")

SINGLE SOCKET CONTAINING TWO LAMPS TOWARD OPPOSITE DIRECTIONS

BACKGROUND OF THE INVENTION

The present invention relates to Christmas light and more particularly to a single socket containing two lamps toward opposite direction in which the socket is closed from a lateral periphery thereof.

Normally, the structure of most Christmas lights has a single socket contained a single lamp and connects in series a plurality of the single lamp sockets into a string of Christmas lights. Nowadays, a type combined sockets is available in the market and becomes popular among most users due to that this type of Christmas light emits more brightness and beautification than the single lamp type. However, either the single direction and/or the opposite directions Christmas light requires the conventional electric wires with the contact plates disposed into the sockets in order to connect the electricity for lightening the lamps, so as to occupy a great deal of spaces in the socket and the contact plate always loosens or disconnects with the electric wire because of the pulling and dragging by the user during the stage of decoration.

If a pair combined sockets are toward two directions, the assembly of the contact plates in the sockets either from the top or the bottom of the sockets is very difficult and cause high rate of rejected products. Thus few of the producers manufactures the combined sockets of the Christmas light.

SUMMARY OF THE PRESENT INVENTION

The present invention has a main object to provide a single socket containing two lamps toward opposite directions in which the contact plates and the electric wires are assembled and closed from a lateral periphery of the socket which is easy and stable.

Another object of the present invention is to provide a single socket containing two lamps toward opposite directions in which a pair of retaining rings are provided to stabilize a covering plate and ensures the electric wires to suffer greater pulling force.

Accordingly, the single socket containing two lamps toward opposite directions of the present invention comprises generally a tubular socket which includes an upper portion, a lower portion, a lateral opening, a pair of wire groove inside the opening, a pair of slits for disposing the contact plates and a plurality of positioning through holes in the predetermined positions, a pair of lamps respectively engaged within the upper and the lower rims thereof each including a pair of lead-in wires engaged with the contact plates, a covering plate closing the lateral opening of the socket having a plurality of combining plates and a pair of wire grooves respectively engaged with the positioning through hole and the wire grooves of the socket and a pair of retaining rings wrapped on the outer periphery of the socket for securing the covering plate. So that this type of single socket containing two lamp achieves a ready assembly and the structure stability.

The present invention will become more fully understood by reference to the following detailed description thereof when read in conjunction with the attached drawings.

DETAILED DESCRIPTION OF THE PREFERRED EMBODIMENT

Figure 1:
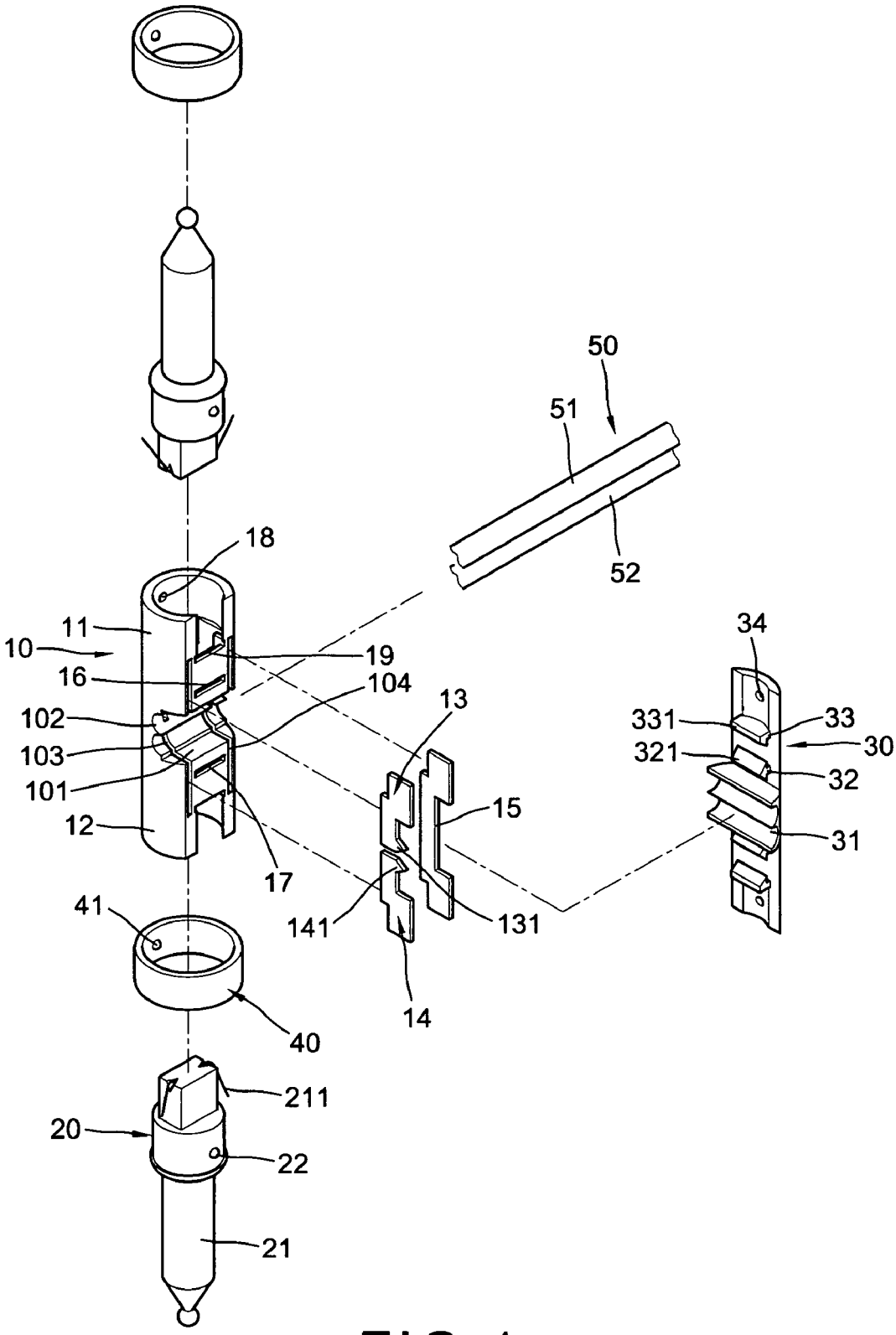
FIG. 1 is an exploded perspective view of the first embodiment of the present invention.
Figure 2:
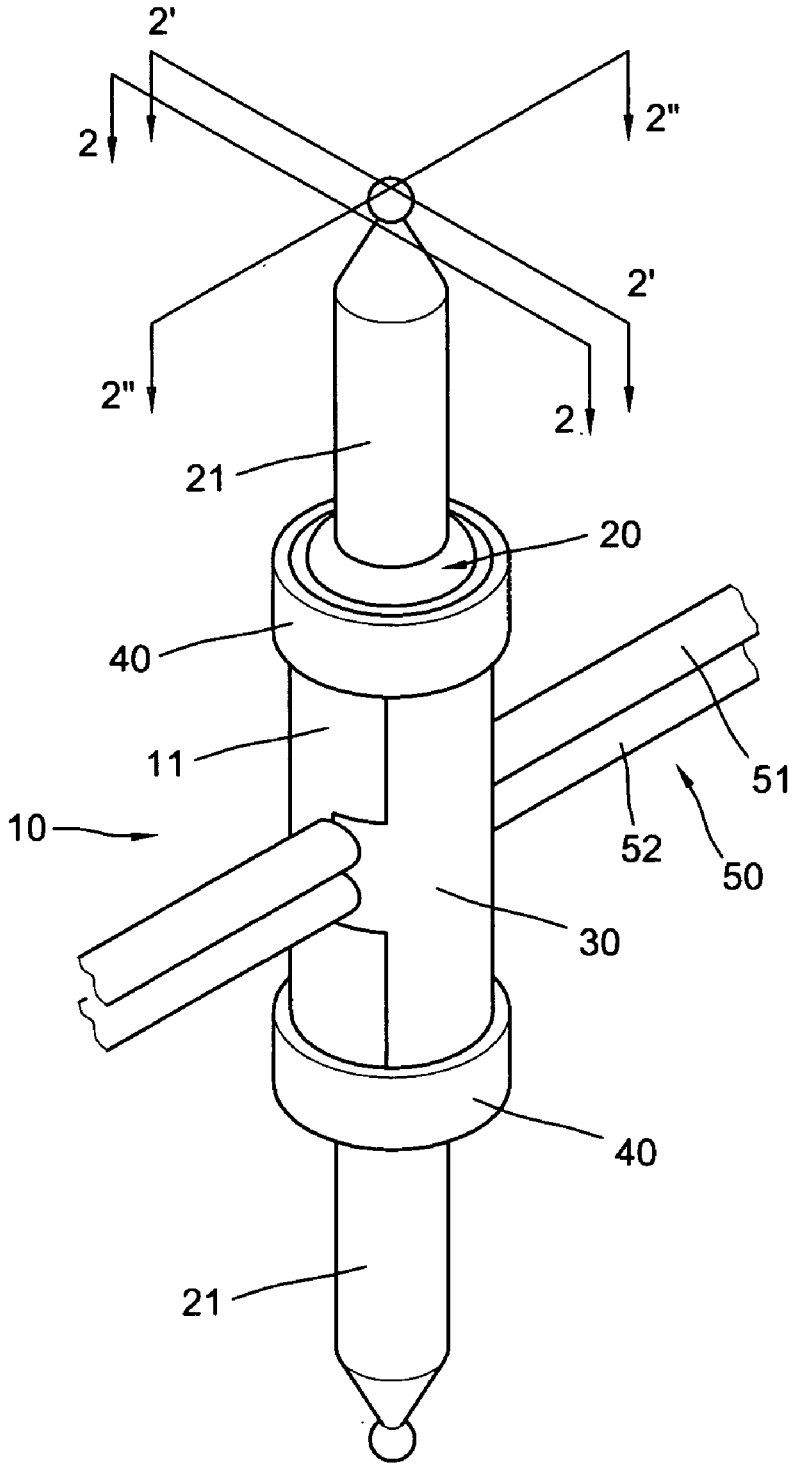
FIG. 2 is a perspective view to show the assembly of FIG. 1.
Figure 3:
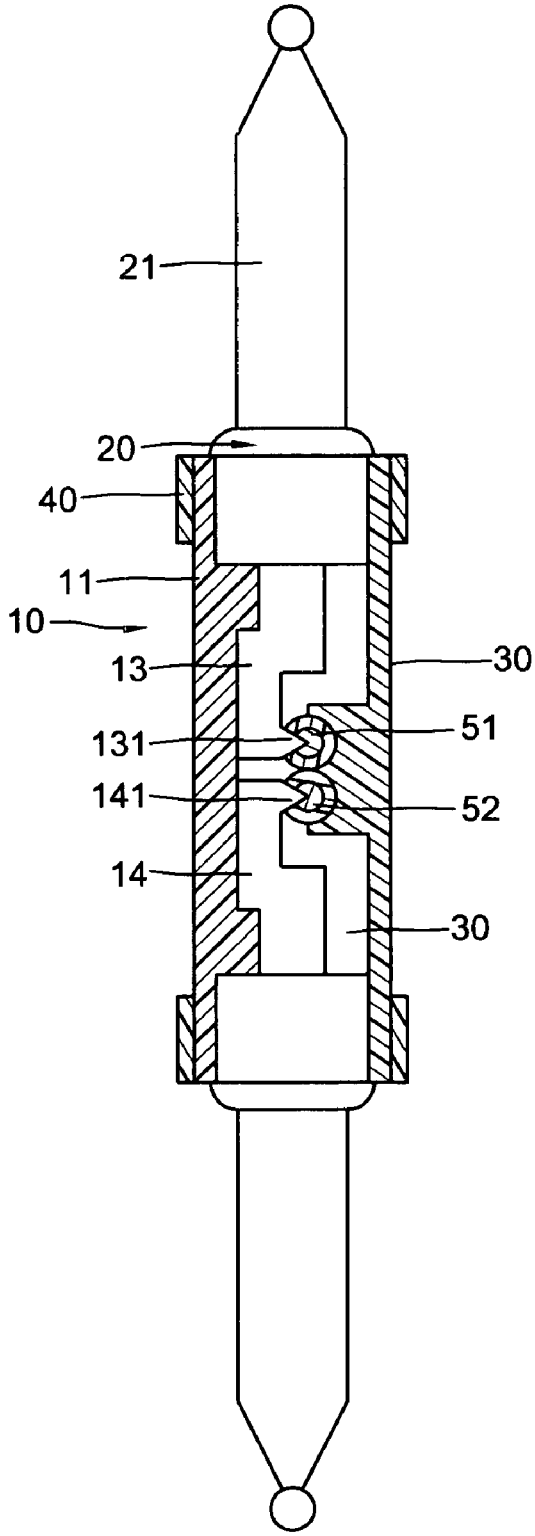
FIG. 3 is a sectional view taken along line 2—2 of FIG. 2.
Figure 4:
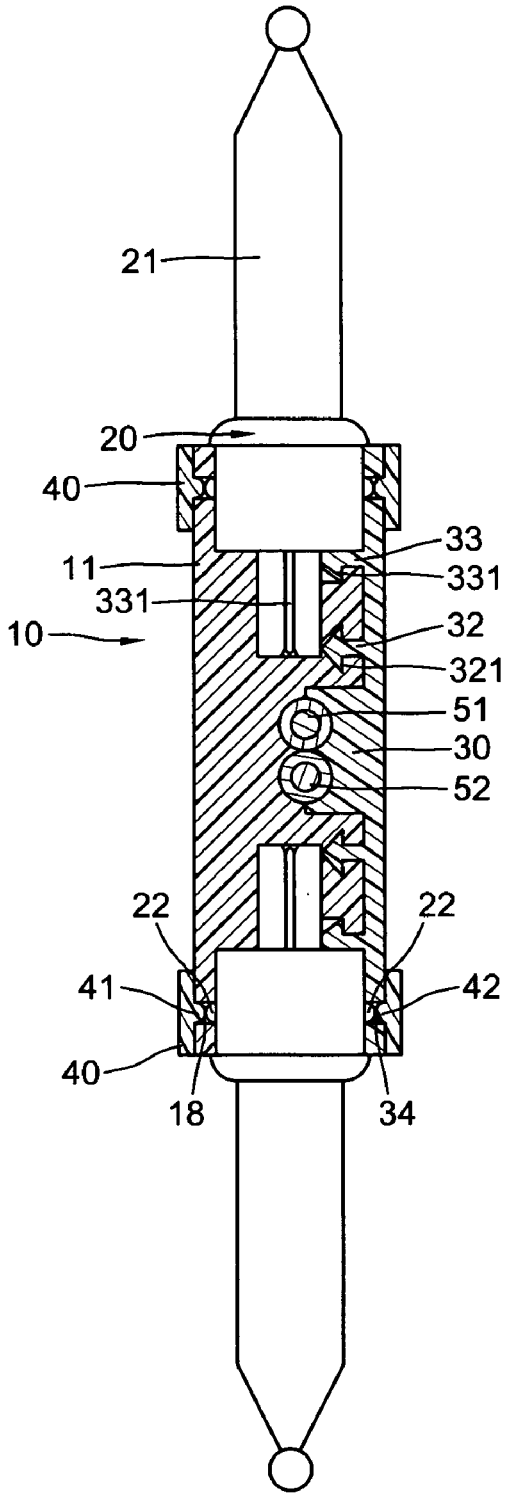
FIG. 4 is a sectional view taken along line 2'—2' of FIG. 2.
Figure 5:
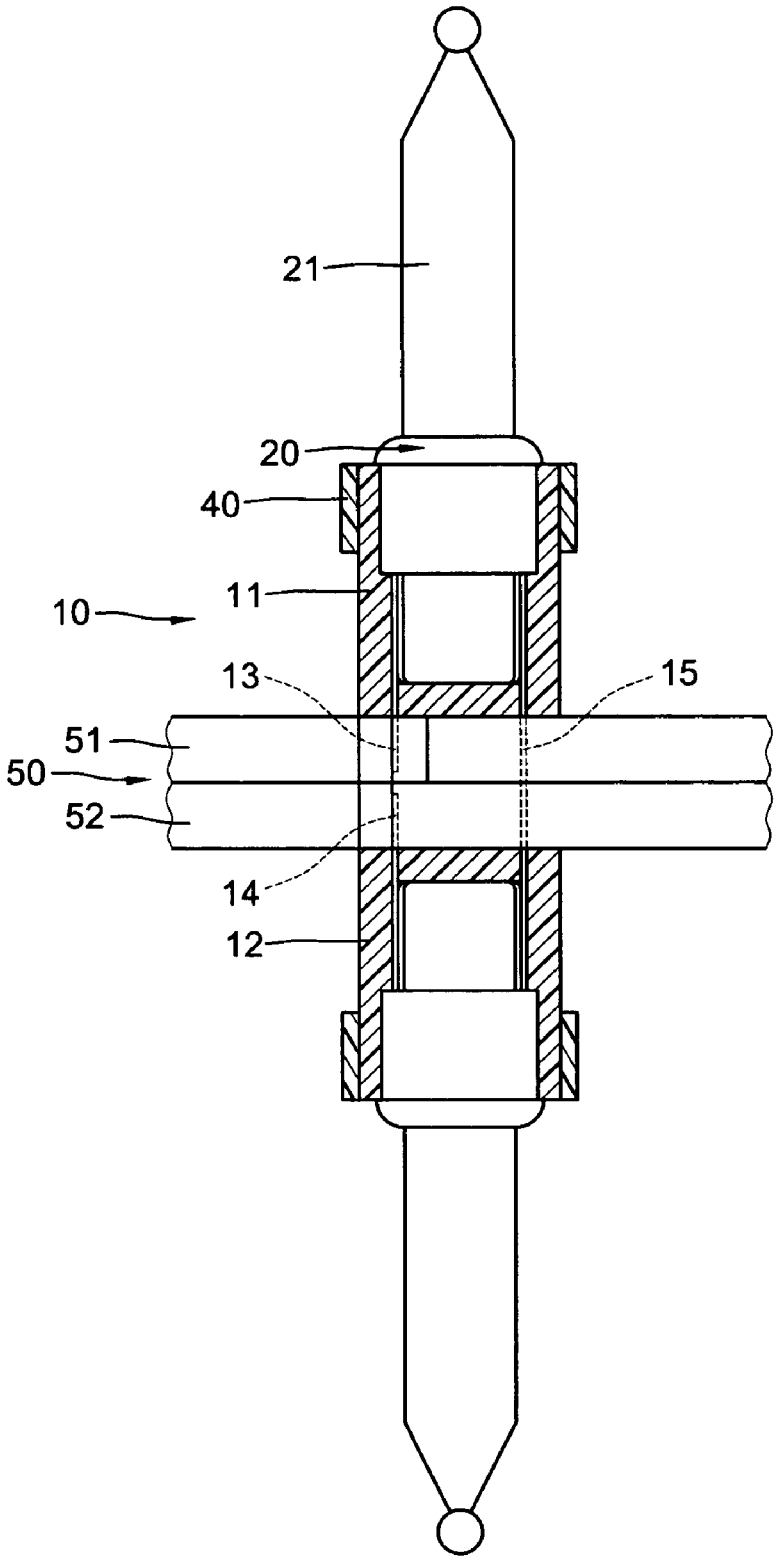
FIG. 5 is a sectional view taken along line 2"—2" of FIG. 2.

With reference to the drawings and initiated from FIGS. 1 to 5, the single socket containing two lamps toward opposite directions of the present invention comprises a tubular socket 10 which includes an upper portion 11 and a lower portion 12 a longitudinal lateral opening with a concaved space in a middle portion of the opening, an introrse plate 101 abutting pair of first wire grooves 102 in the center of the concaved space, a pair of insertion slits 103 and a single slit 104 in the lateral sides of the introrse plate 101 for respectively engaging the contact plates 13, 14 and 15, wherein the contact plates 13 and 14 simultaneously and spacedly engage with the insertion slits 103 and each having tip 131 and 141 at a free end and the contact plate 15 is of a common contact plate without tip and positioned in the upper and lower portion 11 and 12 therethrough, a pair of transverse retaining slots 16 and 17 respectively formed in the flat surface of the upper and lower portions 11 and 12 and a retaining recess 18 in an inner periphery of the upper and lower portions 11 and 12, a pair of corresponding lamps 20 respectively engaged within the upper and lower portions 11 and 12 each of which has a base, a bulb 21, a pair of protrusions 22 on opposing peripheries, wherein one of which engaged within the retaining recess 18 of the upper and lower portions 11 and 12 respectively and a pair of lead-in wires 211 attached on lateral sides and respectively engaged with the contact plates 13 and 14 and the common contact plate 15, an electric wire 50 which is composed of a pair of parallel wires 51 and 52 disposed in the wire grooves 102 of the socket 10 and pierced by the tips 131 and 141 respectively, a cover 30 engaged with the lateral opening of the socket 10 having on the inner side a pair of corresponding wire grooves 31 engaged the wire grooves 102, a pair of first retaining plates 32 each having triangular hook 321 at free end adjacent the upper and lower sides of the corresponding wire grooves 31 engaged within the retaining slots 16 and 17 of the socket 10, a pair of second retaining plates 33 above and beneath the first retaining plates 32 each having a triangular hook at free end also respectively engaged with the upper and lower edges 19 of the flat surfaces of the socket and a pair of corresponding retaining recesses 34 adjacent the upper and lower ends engaged with the other one of the protrusions 22 of the lamps 20 respectably and a pair of elastic retaining rings 40 respectively sleeved on the outer periphery of the upper and lower portions 11 and 12 of the socket 10 each having a pair of protrusions 41 and 42 in the opposing inner peripheries engaged within the outer end of the retaining recesses 18 and 34.

Upon the above arrangement, the advantages of the present invention is prominent in that the contact plates are readily to engage within the socket 10 and the assembly of the lamps 20 and the cover 30 as well as the electric wire 50 onto the socket 10 is more stable and durable.

Figure 6:
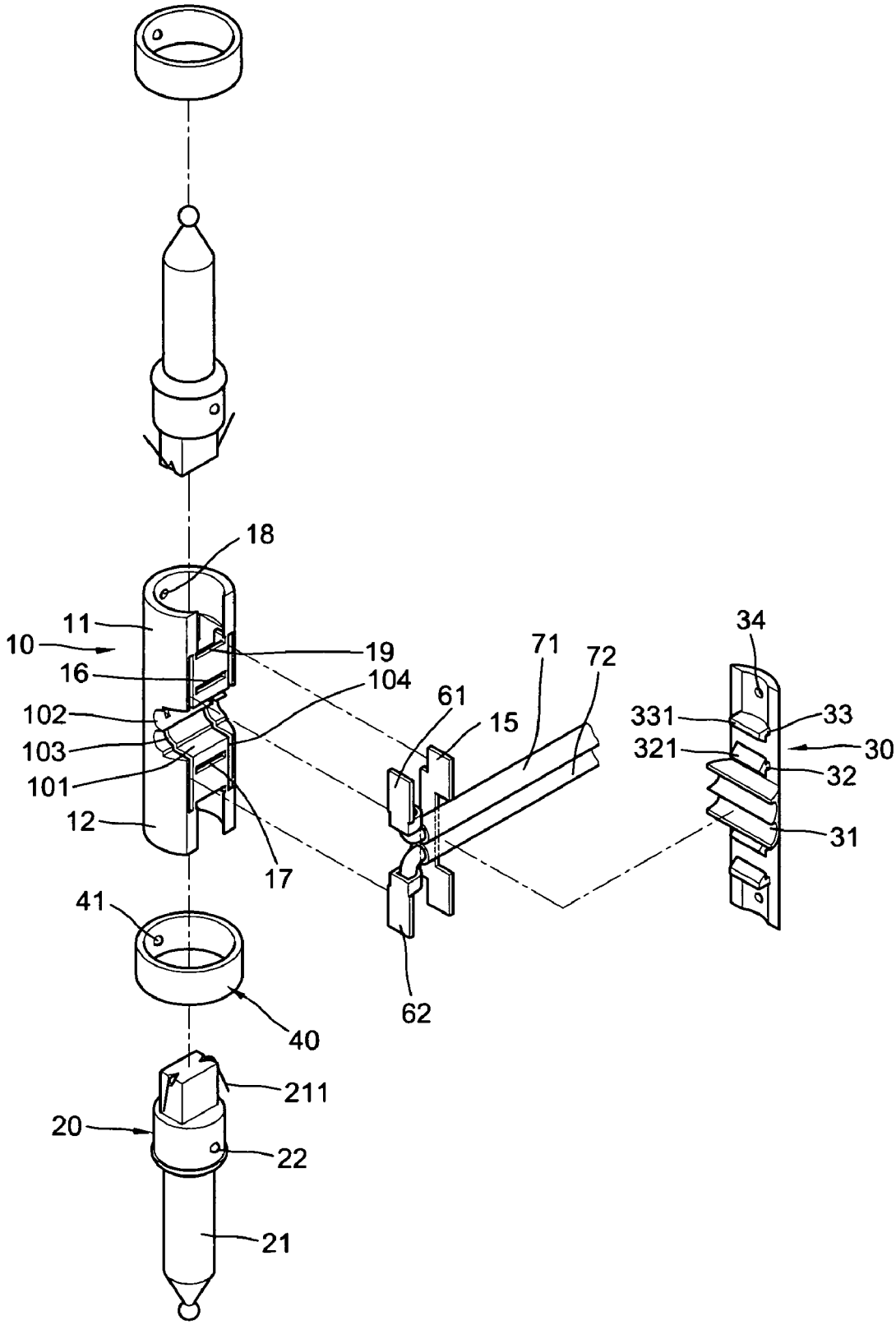
FIG. 6 is an exploded perspective view of the second embodiment of the present invention.
Figure 7:
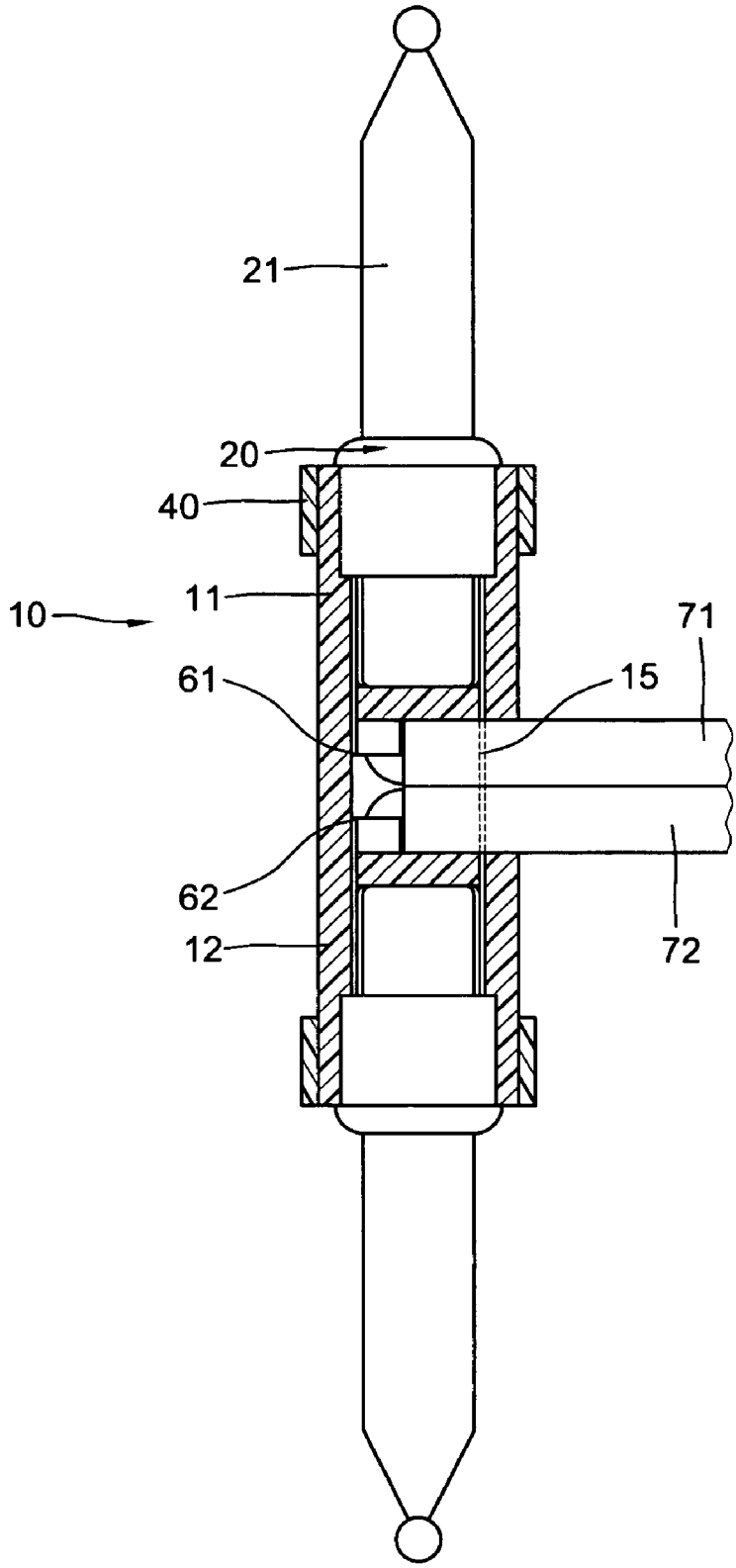
FIG. 7 is a sectional view to show the assembly of FIG. 6.

Referring to FIGS. 6 and 7 of the drawings, a second or alternate embodiment of the present invention is provided. This embodiment is structurally and functionally most similar to the first embodiment as described in FIGS. 1 to 5 and the above discussion are applicable in the most instances. The only modification is that the pair of tipped contact plates 13 and 14 are replaced with a pair of the rectangular contact plates 61 and 62 each of which has a coupling ring at one end and respectively connects the free end of a pair of electric wires 71 and 72. The electric wires 71 and 72 are also gripped by the wire grooves 102 and 31 and extended outward from a lateral side of the socket 10.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A single socket containing two lamps toward opposite directions comprising:

a tubular socket having a rimmed upper portion, a rimmed lower portion, a longitudinal lateral opening in which is an introrse plate, a pair of first wire grooves in a center, a pair of flat surfaces above and beneath said wire grooves, a pair of separated insertion slits and a single insertion slit respectively formed in lateral sides of said flat surfaces each having a transverse retaining slot and a retaining edge and a pair of first retaining recesses respectively formed through a peripheral wall of the upper and lower portions of said socket adjacent their rims thereof;

a pair of first contact plates respectively engaged within the separated insertion slits each having a tip at inner end and a common contact plate engaged within the single insertion slit through the upper and lower portions of said socket;

a pair of electric wires parallel disposed within the first wire grooves of said socket and pierced by the tips of said first contact plates respectively;

a covering plate closed the longitudinal lateral opening of said socket having on inner side a pair of second wire grooves on a center engaged with said first wire grooves, two pairs of hooked plates spacedly formed above and beneath said second wire grooves and a pair of second retaining recesses respectively formed adjacent upper and lower ends thereof made in registry with the first retaining recesses of said socket;

a pair of lamps inserted into the rim of the upper and lower portions of said socket each having a base, a bulb, a pair of lead-in wires respectively engaged with one of said first contact plates and said common plate and a pair of protrusions formed on opposing outer peripheries of the base and respectively engaged with the first retaining recesses of said socket and the second retaining recesses of said covering plate;

a pair of retaining rings respectively sleeved the upper and lower portions of said socket each having a pair of protrusions respectively formed on opposing inner peripheries thereof engaged within outer end of the first retaining recesses of said socket and the second retaining recesses of said covering plate respectively.

2. The single socket as recited in claim 1, wherein said first contact plates are replaceable with a pair of rectangular contact plates each including a coupling ring at inner end directly connected with free ends of a pair of electric wires which engage with the first and second wire grooves and extend outward from a lateral side of said socket.

* * * * *